US007620361B2

(12) United States Patent
Aiko

(10) Patent No.: US 7,620,361 B2
(45) Date of Patent: Nov. 17, 2009

(54) IMAGE FORMING APPARATUS AND CONTROL METHOD THEREFOR

(75) Inventor: Yasuyuki Aiko, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 538 days.

(21) Appl. No.: 11/337,790

(22) Filed: Jan. 23, 2006

(65) Prior Publication Data

US 2006/0177253 A1 Aug. 10, 2006

(30) Foreign Application Priority Data

Jan. 24, 2005 (JP) ..... 2005-016136

(51) Int. Cl.
*G03G 15/00* (2006.01)

(52) U.S. Cl. ..... 399/394; 399/381; 399/388

(58) Field of Classification Search ..... 399/361–396
See application file for complete search history.

(56) References Cited

U.S. PATENT DOCUMENTS 6,934,504 B2 * 8/2005 Morita ..... 399/394
7,319,842 B2 * 1/2008 Koyanagi et al. ..... 399/395

FOREIGN PATENT DOCUMENTS

JP 61275775 A * 12/1986
JP 3-46946 A 2/1991
JP 9-77309 A 3/1997
JP 9-244339 A 9/1997
JP 2001-337576 A 12/2001
JP 2002099192 A * 4/2002
JP 2002370391 A * 12/2002
JP 2003248410 A * 9/2003
JP 2004233712 A * 8/2004

* cited by examiner

*Primary Examiner*—Judy Nguyen
*Assistant Examiner*—'Wyn' Q Ha
(74) *Attorney, Agent, or Firm*—Rossi, Kimms & McDowell, LLP

(57) ABSTRACT

An image forming apparatus, which is capable of correctly and accurately detecting a sheet leading edge position and carrying out image formation in appropriate image write timing, includes a detection device disposed at a reference position upstream from the transfer position and detects the recording medium being conveyed. A determining device determines image write timing for forming the electrostatic latent image on the photosensitive drum based on a difference in position between a leading edge position of the recording medium detected by said detection device and the reference position. The detection device respectively include a plurality of light detecting pixels disposed in a recording medium conveying direction, and the leading edge position of the recording medium detected by the respective light detecting pixels.

8 Claims, 11 Drawing Sheets

*FIG. 11A* (PRIOR ART) SKEWING
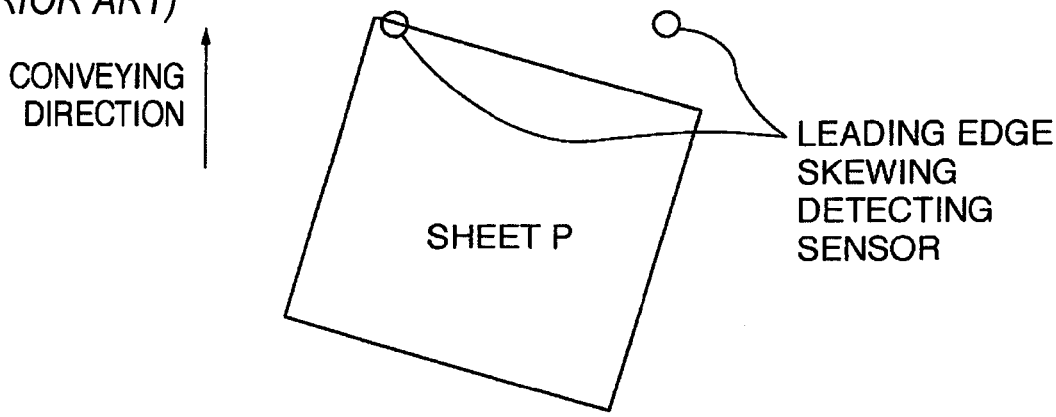
*FIG. 11B* (PRIOR ART) SMALL SHEET
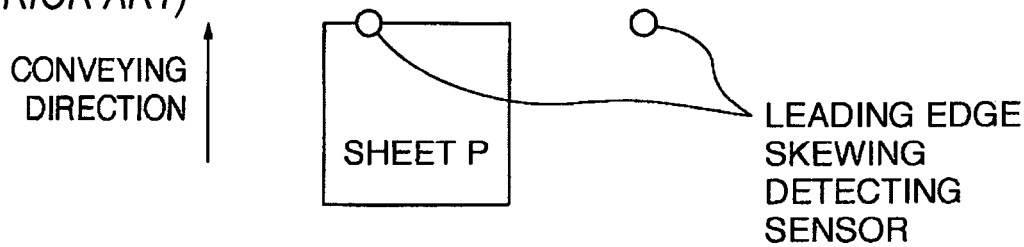
*FIG. 11C* (PRIOR ART) SKEW AMOUNT DETECTED
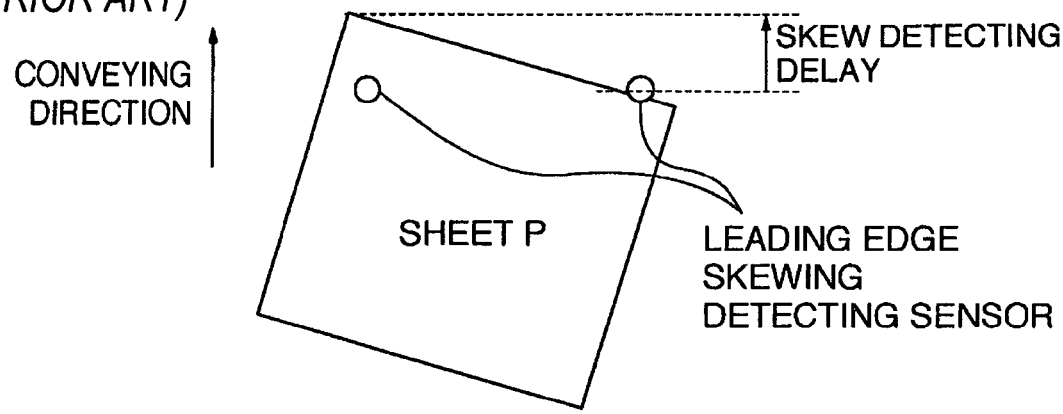

IMAGE FORMING APPARATUS AND CONTROL METHOD THEREFOR

BACKGROUND OF THE INVENTION

1. Field of the Invention

The present invention relates to an image forming apparatus that carries out image formation on a recording medium such as paper using an electrophotographic method and to a control method therefor.

2. Description of the Related Art

In an image forming apparatus, such as a digital copying machine, image formation is carried out by scanning a photosensitive drum with modulated laser light to form an electrostatic latent image, developing the electrostatic latent image using toner, and transferring the toner image to a recording medium such as paper.

For example, there are apparatuses that determine the timing at which to start the scanning of the photosensitive drum with the laser light based on a detection result of a means (a reflective-type sensor) that detects a leading edge position of a sheet being conveyed as the recording medium. An image forming apparatus has been proposed that transfers the toner image after carrying out control to determine the timing so that a leading edge of the image and a recording position on the sheet are aligned at a transfer position facing the photosensitive drum and thereby avoids missing the image due to the image being displaced on the sheet (see, for example, Japanese Laid-Open Patent Publication (Kokai) No. H09-244339).

There is also an image forming apparatus including a leading edge detecting sensor which, aside from the object of aligning the recording position at the transfer position, detects the timing in which the leading edge of the sheet arrives on a conveying path and changes the sheet conveying speed and/or the conveying path.

An image forming apparatus that uses an actuator-type sensor instead of a reflective-type sensor as the means for detecting the leading edge position of the sheet being conveyed has also been proposed (see, for example, Japanese Laid-Open Patent Publication (Kokai) No. H09-077309).

According to the conventional art described above, a reflective-type sensor or an actuator-type sensor is used in an image forming apparatus as the leading edge detecting sensor that detects the leading edge position of the sheet being conveyed. In addition, in Japanese Laid-Open Patent Publication (Kokai) No. H09-244339, processing is started when the leading edge detecting sensor detects that the leading edge of a sheet has arrived. For this reason, a method is used where an output of the leading edge detecting sensor is connected to an interrupt terminal of a central processing unit (hereinafter referred to as "the CPU") and the leading edge of the sheet is detected when an interrupt has occurred from the leading edge detecting sensor.

However, as shown in FIG. 9, the leading edge of a sheet P conveyed on a conveying path while being sandwiched by conveying rollers 813 in the image forming apparatus constantly meanders on the conveying path as the sheet advances. Accordingly, when the leading edge of the sheet P is detected by a reflective-type leading edge detecting sensor 801, for example, the output signal of the leading edge detecting sensor 801 fluctuates such as a wave as shown by reference numeral 802 and only becomes stable over time. Accordingly, there is the following problem for a method where the output signal of the leading edge detecting sensor 801 is inputted to the interrupt terminal of the CPU to directly produce an interrupt request for the CPU. That is, since a plurality of interrupt requests are issued at every transition point, it is not possible to correctly determine the leading edge positions of respective sheets or the number of sheets that have passed the sensor.

For this reason, normally, as shown by reference numeral 803, after the output signal of the leading edge detecting sensor 801 becomes the transition point, interrupts are inhibited from occurring until the output signal has stabilized for a predetermined time period. That is, a method is used where a noise removing counter is installed between the leading edge detecting sensor 801 and the CPU (hereinafter referred to as "the first example"). However, due to the noise removing counter being installed, a delay ΔD is produced between detection time of the leading edge of the sheet P and the issuing time of the actual interrupt request. The delay ΔD varies due to the type of sheet P, the conveying path, and conditions relating to the conveying rollers 813 and the like, and cannot be predicted in advance.

As an alternative to the method described above, there is a method that periodically monitors the output of the leading edge detecting sensor 801 using a control section and detects a change in the output of the leading edge detecting sensor 801 as a sheet leading edge (or a sheet trailing end of a sheet) (hereinafter referred to as "the second example"). In this case also, a detection error "Δd" expressed by $$\Delta d \leqq V*t$$

is produced where "V" represents the sheet conveying speed and "t" represents a sensor detection period of the control section.

In addition, since it is necessary to carry out processing using a timer or the like to somewhat eliminate detection errors due to noise as described above, the detection error Δd is further increased.

If uncorrected, the delay ΔD and the detection error Δd described above can cause misalignment when transferring an image onto the sheet. On the other hand, since this sort of image forming apparatuses have been increasingly used as portable printers in recent years, there is demand for improved accuracy for the print position. That is, to prevent displacement of transferred images and/or to prevent fluctuations in the transfer positions of images, it is necessary to minimize the delay ΔD or the detection error Δd.

For this reason, especially for a high-speed image forming apparatus where the sheet conveying speed V is high, for the first example described above, it is necessary to shorten the count operation of the noise removing counter (i.e., to lower the INT level in FIG. 9). For the second example, the sensor detecting period t of the control section needs to be made as short as possible.

However, if the count operation of the noise removing counter is shortened, this can cause erroneous operations due to noise included in the output signal of the leading edge detecting sensor. Also, to shorten the sensor detecting period t of the control section, a control section that operates at high speed is required, which can lead to an increase in power consumption and in more radiation energy being radiated to the periphery of the image forming apparatus.

There is also the following problem. FIG. 10A shows the case where the sheet P is conveyed in a normal state. FIG. 10B shows the case where the sheet P is conveyed with the sheet P skewed with respect to the conveying direction, resulting in the possibility of part of the image being printed outside the sheet P so that information is lost. To prevent this, it is necessary to correctly detect a skew amount (tilt amount) of the sheet and thereby carry out skew correction for the image, write timing correction for the image, and the like.

When detecting the correct skewing amount of the sheet, there is a method that disposes a plurality of leading edge skewing detecting sensors as shown in FIGS. 11A to 11C. However, according to this method, by merely having one of the leading edge skewing detecting sensors detect the sheet leading edge, it is not possible to determine whether the sheet P is skewed (see FIG. 11A) or whether the width of the sheet P is narrow (see FIG. 11B). Also, even if the sheet P is skewed, the skewing amount will only be known when the sheet P is conveyed further and the second leading edge skewing detecting sensor detects the sheet P (see FIG. 11C).

For this reason, to correct the image write timing when scanning the photosensitive drum with the laser light to form the latent image, the position at which skewing of the sheet is detected needs to be a sufficient distance upstream of a position corresponding to an image write start position. Since this results in an increase in the length of the conveying path required to detect skewing of the sheet, there is the problem that the image forming apparatus becomes large.

SUMMARY OF THE INVENTION

It is an object of the present invention to provide an image forming apparatus that is capable of correctly and accurately detecting a sheet leading edge position and carrying out image formation in appropriate image write timing, and a control method therefor.

To attain the above object, in a first aspect of the present invention, there is provided an image forming apparatus that carries out image formation by forming an electrostatic latent image on a photosensitive drum and transferring an image produced by developing the electrostatic latent image onto a recording medium conveyed to a transfer position of the photosensitive drum, the image forming apparatus comprising a detection device that is disposed at a reference position upstream from the transfer position and detects the recording medium being conveyed, and a determining device that determines image write timing for forming the electrostatic latent image on the photosensitive drum based on a difference in position between a leading edge position of the recording medium detected by the detection device and the reference position, wherein the detection device includes a plurality of light detecting pixels disposed in a recording medium conveying direction, and the leading edge position of the recording medium is detected by the respective light detecting pixels.

Preferably, the determining device determines the image write timing by setting standard image write timing based on a conveying speed of the recording medium, a conveying distance of the recording medium from the reference position to the transfer position, a distance from a formation position of the electrostatic latent image on the photosensitive drum to the transfer position, and a movement speed of the photosensitive drum, and correcting the standard image write timing based on the difference in position between the leading edge position of the recording medium detected by the detection device and the reference position.

To attain the above object, in a second aspect of the present invention, there is provided an image forming apparatus that carries out image formation by forming an electrostatic latent image on a photosensitive drum and transferring an image produced by developing the electrostatic latent image onto a recording medium conveyed to a transfer position of the photosensitive drum, the image forming apparatus comprising a first detection device that is disposed at a first reference position upstream from the transfer position and detects the recording medium being conveyed, a second detection device that is disposed at a second reference position upstream from the first reference position and detects the recording medium being conveyed, a calculation device that calculates an error in a conveying speed of the recording medium between the first and second reference positions based on a difference in position between a leading edge position of the recording medium detected by the first detection device and the first reference position and a difference in position between a leading edge position of the recording medium detected by the second detection device and the second reference position, and a correcting device that corrects image write timing for forming the electrostatic latent image on the photosensitive drum based on the error in the conveying speed calculated by the calculation device.

To attain the above object, in a third aspect of the present invention, there is provided an image forming apparatus that carries out image formation by forming an electrostatic latent image on a photosensitive drum and transferring an image produced by developing the electrostatic latent image onto a recording medium conveyed to a transfer position of the photosensitive drum, the image forming apparatus comprising a first detection device that is disposed upstream from the transfer position and detects the recording medium being conveyed, a second detection device that is disposed in a recording medium width direction with respect to the first detection device and detects the recording medium being conveyed, and a calculation device that calculates a conveying skew angle of the recording medium based on a difference in position between a leading edge position of the recording medium detected by the first detection device and a leading edge position of the recording medium detected by the second detection device, and a correcting device that corrects image write timing for forming the electrostatic latent image on the photosensitive drum based on the conveying skew angle calculated by the calculation device.

Preferably, the correcting device carries out rotation to rotate image data by a predetermined angle.

More preferably, the detection device includes a plurality of light detecting pixels detecting incident lights and a plurality of registers disposed so as to correspond to the respective light detecting pixels and into which image data corresponding to an incident light amount detected by the corresponding light detecting pixels for the respective light detecting pixels can be moved.

More preferably, the first detection device and the second detection device respectively include a plurality of light detecting pixels disposed in a recording medium conveying direction and detecting incident lights and a plurality of registers disposed so as to correspond to the respective light detecting pixels and into which image data corresponding to an incident light amount detected by the corresponding light detecting pixels for the respective light detecting pixels can be moved.

Furthermore preferably, the image forming apparatus further comprises a leading edge position determining device that determines the leading edge position of the recording medium by converting an output of the detection device or outputs of the first detection device and the second detection device to binary.

To attain the above object, in a fourth aspect of the present invention, there is provided a method of controlling an image forming apparatus that carries out image formation by forming an electrostatic latent image on a photosensitive drum and transferring an image produced by developing the electrostatic latent image onto a recording medium conveyed to a transfer position of the photosensitive drum, the method comprising a timing determining step of determining image write timing for forming the electrostatic latent image on the photosensitive drum based on a difference in position between a leading edge position of the recording medium detected by a detection device disposed at a reference position upstream from the transfer position and the reference position.

To attain the above object, in a fifth aspect of the present invention, there is provided a method of controlling an image forming apparatus that carries out image formation by forming an electrostatic latent image on a photosensitive drum and transferring an image produced by developing the electrostatic latent image onto a recording medium conveyed to a transfer position of the photosensitive drum, the method comprising a calculation step of calculating an error in a conveying speed of the recording medium between a first reference position upstream from the transfer position and a second reference position upstream from the first reference position based on a difference in position between a leading edge position of the recording medium detected by a first detection device disposed at the first reference position and the first reference position and a difference in position between a leading edge position of the recording medium detected by a second detection device disposed at the second reference position and the second reference position, and a correcting step of correcting image write timing for forming the electrostatic latent image on the photosensitive drum based on the error in the conveying speed calculated by the calculation step.

To attain the above object, in a sixth aspect of the present invention, there is provided a method of controlling an image forming apparatus that carries out image formation by forming an electrostatic latent image on a photosensitive member drum and transferring an image produced by developing the electrostatic latent image onto a recording medium conveyed to a transfer position of the photosensitive member drum, the method comprising a calculation step of calculating a conveying skew angle of the recording medium based on a difference in position between a leading edge position of the recording medium detected by a first detection device disposed upstream from the transfer position and a leading edge position of the recording medium detected by a second detection device disposed in a recording medium width direction with respect to the first detection device, and a correcting step of correcting image write timing for forming the electrostatic latent image on the photosensitive member drum based on the conveying skew angle calculated by the calculation step.

The above and other objects, features, and advantages of the invention will become more apparent from the following detailed description taken in conjunction with the accompanying drawings.

BRIEF DESCRIPTION OF THE DRAWINGS

FIGS. 11A to 11C are diagrams showing conveying states of sheets, with FIG. 11A showing a case where a sheet is conveyed in a skewed state, FIG. 11B showing a state where a small-size sheet is conveyed, and FIG. 11C showing a method of detecting a skew amount.

DETAILED DESCRIPTION OF THE PREFERRED EMBODIMENTS

The present invention will now be described in detail with reference to the drawings showing preferred embodiments thereof. It should be noted that the relative arrangement of the components, the numerical expressions and numerical values set forth in these embodiments do not limit the scope of the present invention unless it is specifically stated otherwise.

Figure 1:
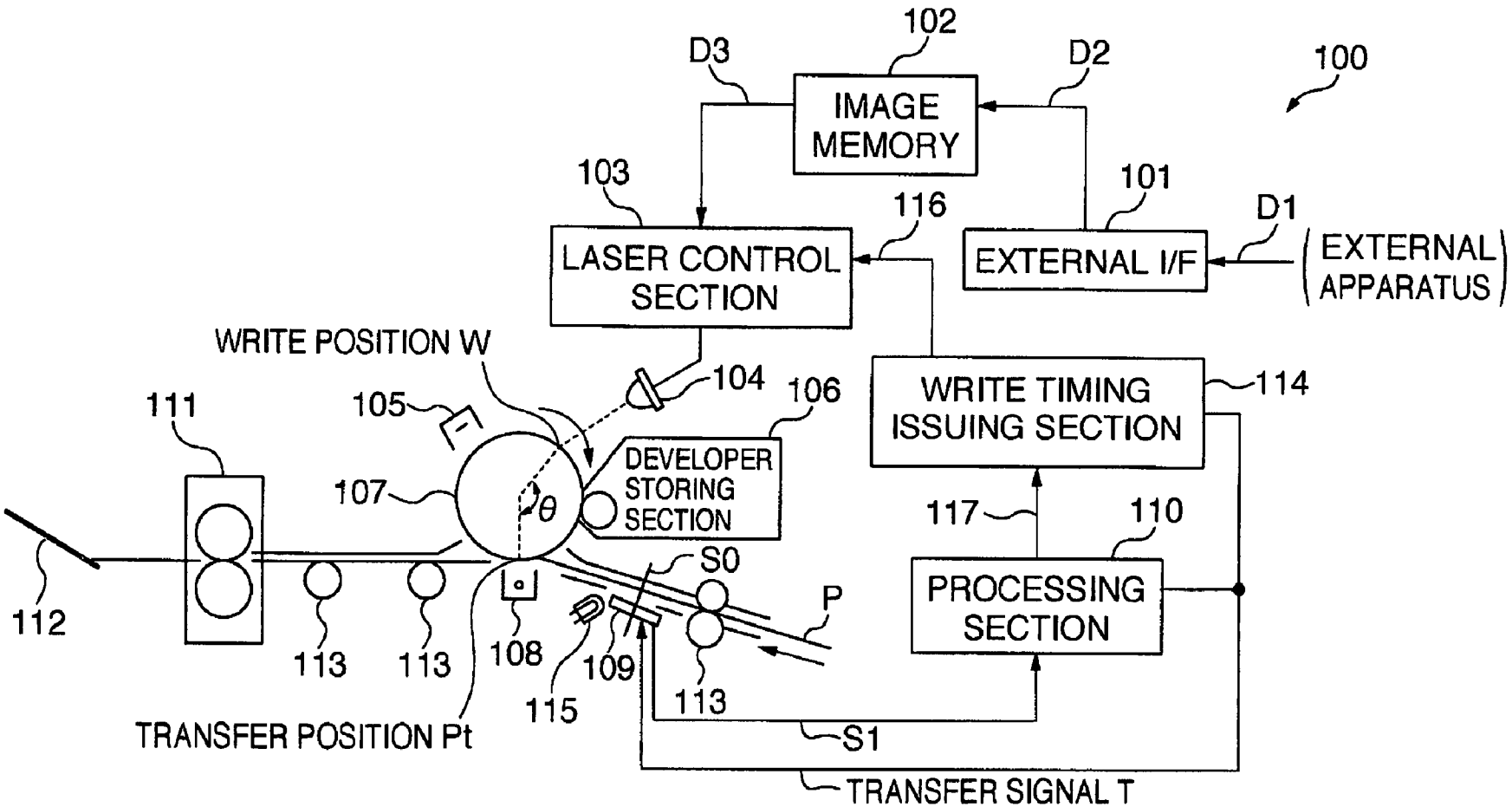
FIG. 1 is a block diagram showing the construction of principal parts of the image forming apparatus according to a first embodiment of the present invention.

FIG. 1 is a block diagram showing the construction of principal parts of an image forming apparatus according to a first embodiment of the present invention.

In FIG. 1, an image forming apparatus 100 is comprised of an external interface (I/F) 101, an image memory 102, a laser control section 103, a laser emitting section 104, a charging section 105, a developer storing section 106, a photosensitive drum 107, an electrostatic transfer section 108, a leading edge detecting sensor (linear contact sensor) 109, a processing section 110, a fixing section 111, a discharging section 112, conveying rollers 113, a write timing issuing section 114, and a light source 115.

The image forming apparatus 100 conveys a sheet P as a recording medium fed from a sheet feeding section, not shown, on a conveying path at a fixed conveying speed V using the conveying rollers 113 and carries out image formation on the sheet using an electrophotographic method described below. The external I/F 101 receives image data D1 transmitted from an external apparatus such as a computer or an image reading apparatus, not shown, and stores the image data D1 as image data D2 in the image memory 102 as an image data storing means.

The sheet P is conveyed by the conveying rollers 113 on the conveying path at the conveying speed V and before long passes above the leading edge detecting sensor 109 disposed as a sheet detecting means in the periphery of a reference position S0 upstream of an image transfer position Pt on the conveying path.

The leading edge detecting sensor 109 is an analog output sensor where a plurality of light detecting elements are aligned in the conveying direction of the sheet P. The leading edge detecting sensor 109 is driven using a repetitive driving clock so that outputs of the respective light detecting elements at the time cycle of the driving clock are outputted as a consecutive serial signal. The light source 115 is a uniform light source, such as LEDs, that illuminates the sheets P that passes above the leading edge detecting sensor 109, with light reflected by the sheet P being incident on the respective light detecting elements of the leading edge detecting sensor 109. Accordingly, the leading edge detecting sensor 109 outputs an analog signal S1 in accordance with a position of the sheet P in detection timing to the processing section 110. The processing section 110 converts the analog signal S1 to binary to produce a sheet leading edge signal 117 outputted to the write timing issuing section 114.

The write timing issuing section 114 issues, in accordance with the sheet leading edge signal 117, an image write timing signal 116 that determines image write timing for forming an electrostatic latent image on the photosensitive drum 107. The write timing issuing section 114 outputs the image write timing signal 116 to the laser control section 103. The laser control section 103 reads the image data D2 from the image memory 102 in accordance with the image write timing signal 116. The laser control section 103 modulates and drives the laser emitting section 104 according to the image data D2 to irradiate the photosensitive drum 107 with laser light.

The photosensitive drum 107 rotates at an angular speed ω in synchronization with the conveying speed of the sheet P. The surface of the photosensitive drum 107 is uniformly charged by the charging section 105 and then an electrostatic latent image is formed at an image write position W by the laser light emitted from the laser emitting section 104. The developer storing section 106 supplies the developer (toner) to the electrostatic latent image on the photosensitive drum 107 to develop the electrostatic latent image and thereby form a toner image. After this, the electrostatic transfer section 108 transfers the toner image on the photosensitive drum 107 onto the sheet P at the image transfer position Pt.

A method of aligning a leading edge of the image on the photosensitive drum 107 and the sheet leading edge (more specifically, a recording position on the sheet) during the transfer will now be described. First, the sheet leading edge is detected by the leading edge detecting sensor 109 at the reference position S0. Here, a magnitude relationship expressed as $$Lt/Vp>\theta/\omega \quad \text{(Expression 1-1)}$$

is set, where "Vp" represents the sheet conveying speed, "Lt" a conveying distance of the sheet P from the reference position S0 to the image transfer position Pt, and "θ" a rotation angle of the photosensitive drum 107 from the image write position (electrostatic latent image formation position) W to the image transfer position Pt. Here, a delay time "td" from output of the sheet leading edge signal 117 to the issuing of the image write timing signal 116 may be set so that $$td=(Lt/Vp)-(\theta/\omega) \quad \text{(Expression 1-2).}$$

That is, the write timing issuing section 114 sets a standard image write timing and corrects the standard image write timing based on a positional difference between the sheet leading edge position detected by the leading edge detecting sensor 109 and the reference position S0. By doing so, the image write timing is determined.

By carrying out such control, the sheet P onto which the image is transferred is conveyed by the conveying rollers 113 and by passing the fixing section 111 that fixes the image on the sheet P, the image is fixed on the sheet that is then discharged to the discharging section 112.

Next, an output format of the image signal (analog signal) S1 from the leading edge detecting sensor 109 and a method by which the processing section 110 outputs the sheet leading edge signal 117 will be described for the image forming apparatus 100 with reference to FIGS. 2 and 3.

Figure 2:
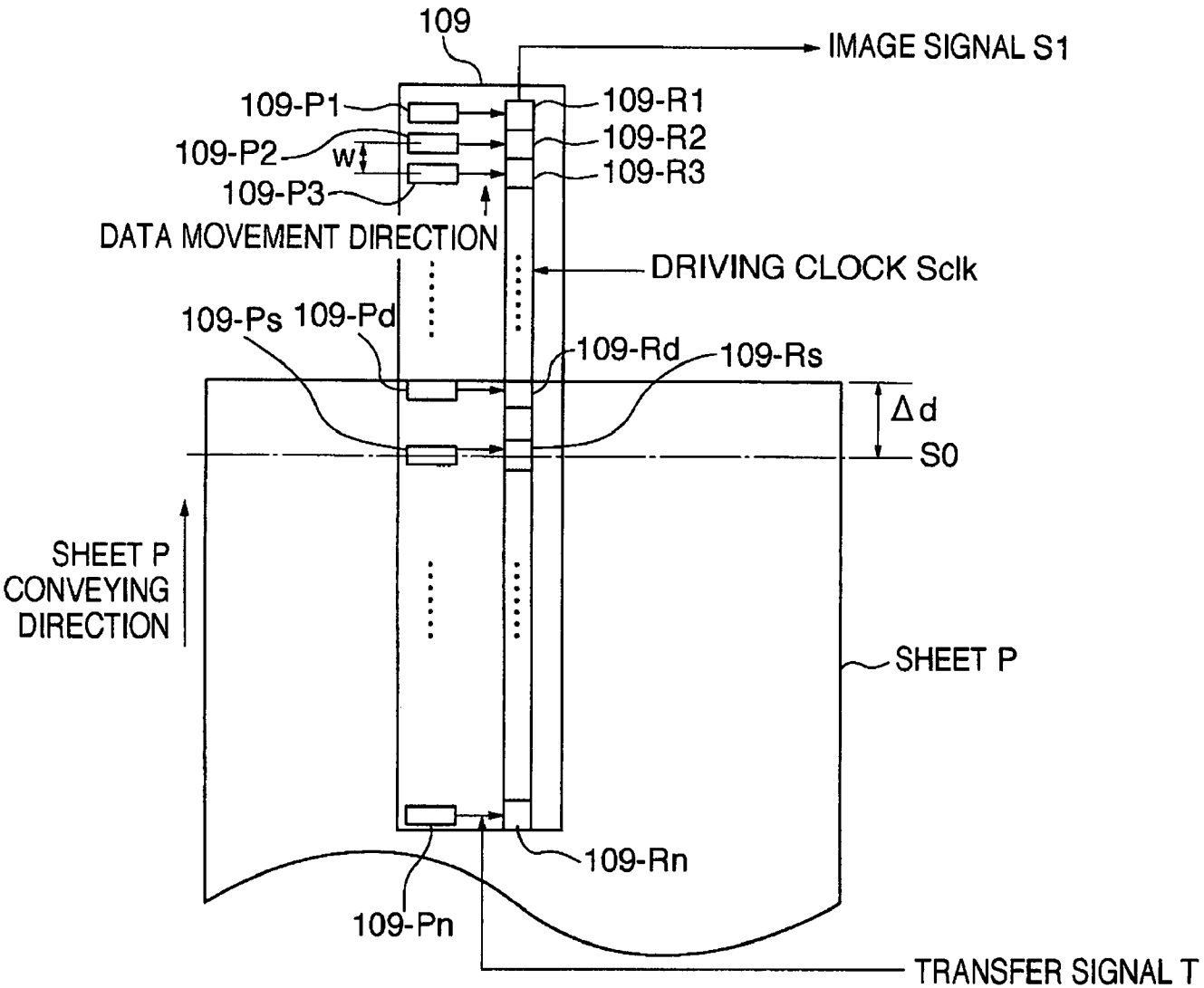
FIG. 2 is a diagram showing the construction of the leading edge detecting sensor appearing in FIG. 1.

FIG. 2 is a diagram showing the construction of the leading edge detecting sensor 109 appearing in FIG. 1.

In FIG. 2, the leading edge detecting sensor 109 includes independent light detecting pixels 109-P1 to 109-Pn disposed in a line in the conveying direction of the sheet P. The leading edge detecting sensor 109 is also constructed as a sensor array including registers 109-R1 to 109-Rn that are disposed so as to respectively correspond to the light detecting pixels 109-P1 to 109-Pn and to which consecutive stored image data can be moved. The leading edge detecting sensor 109 is supplied with a transfer signal T and a driving clock Sclk from a driving circuit (not shown) provided in the processing section 110.

First, in accordance with the supplying of the transfer signal T, the light detecting pixels 109-P1 to 109-Pn of the leading edge detecting sensor 109 move image data corresponding to integral values for an amount of light incident in one period of the transfer signal T to the registers 109-R1 to 109-Rn respectively paired with the pixels 109-P1 to 109-Pn. After this, the registers 109-R1 to 109-Rn are serially driven in accordance with the supplying of the driving clock Sclk and shift the image data to the adjacent register in response to corresponding clock signal. By doing so, the serial image signal (analog signal) S1 is outputted from the first register 109-R1.

Figure 3:
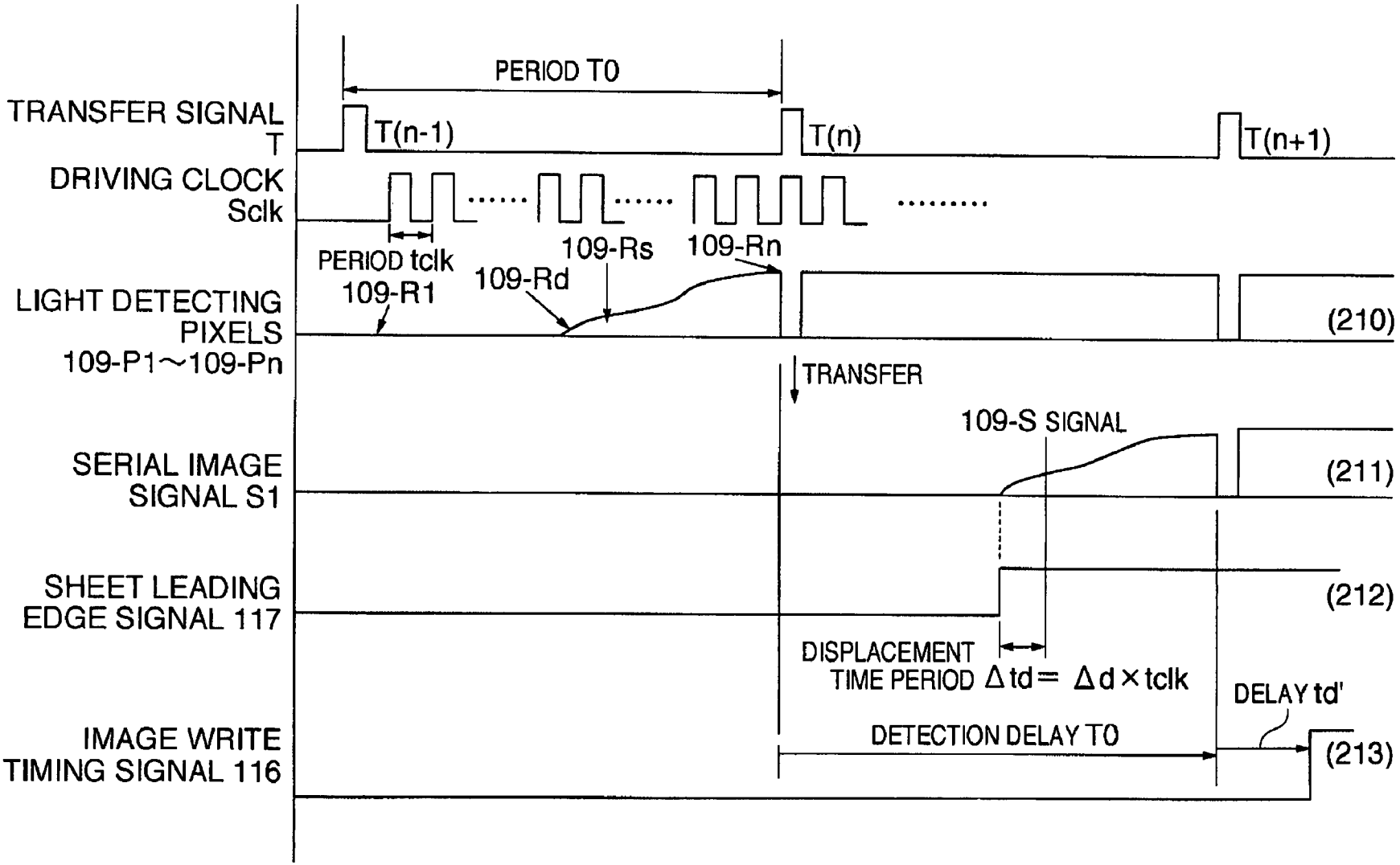
FIG. 3 is a timing chart showing an output signal of the leading edge detecting sensor, a sheet leading edge signal, and a write timing signal.

FIG. 3 is a timing chart showing the output signal of the leading edge detecting sensor 109, the sheet leading edge signal, and the write timing signal.

In FIG. 3, the case is shown where, at a time where an arbitrary transfer signal T(α) is outputted from the driving circuit of the processing section 110, the leading edge of the sheet P has advanced to the light detecting pixel 109 displaced by a distance Δd from the reference position S0 as shown in FIG. 2 described above.

When the leading edge of the sheet P has advanced to the light detecting pixel 109-Pd out of the leading edge detecting sensor 109, as shown in a chart 210, image data proportionate to the time period during which the sheet P is above the respective light detecting pixels are obtained as outputs of the respective light detecting pixels. Such image data are stored in the register 109-R1 to 109-Rn.

Note that if a symbol "d" represents an ordinal number of the light detecting pixel 109-Pd at a position displaced by a distance Δd from the reference position S0, "s" an ordinal number of a light detecting pixel 109-Ps at the reference position S0, and "w" the distance between adjacent pixels, the distance Δd can be calculated as shown below.

$$\Delta d=(d-s)\times w \quad \text{(Expression 1-3)}$$

After this, the driving clock Sclk from the driving circuit of the processing section 110 is inputted to the registers 109-R1 to 109-Rn of the leading edge detecting sensor 109. By doing so, as shown by the chart 210, output values stored in the respective registers in order starting from the first register 109-R1 are outputted to the processing section 110 as the serial image signal (analog signal) S1.

As shown by a chart 212, the image signal (analog signal) S1 outputted from the leading edge detecting sensor 109 is converted to binary by the processing section 110 according to whether a condition such as S1>0 is satisfied, and is then outputted to the sheet leading edge signal 117. By doing so, a time period Δtd corresponding to the distance Δd from the reference position S0 can be obtained.

Next, a method of correcting the delay time period td from the output of the sheet leading edge signal 117 to the issuing of the image write timing signal 116 will be described with reference to FIGS. 4 and 5.

Figure 4:
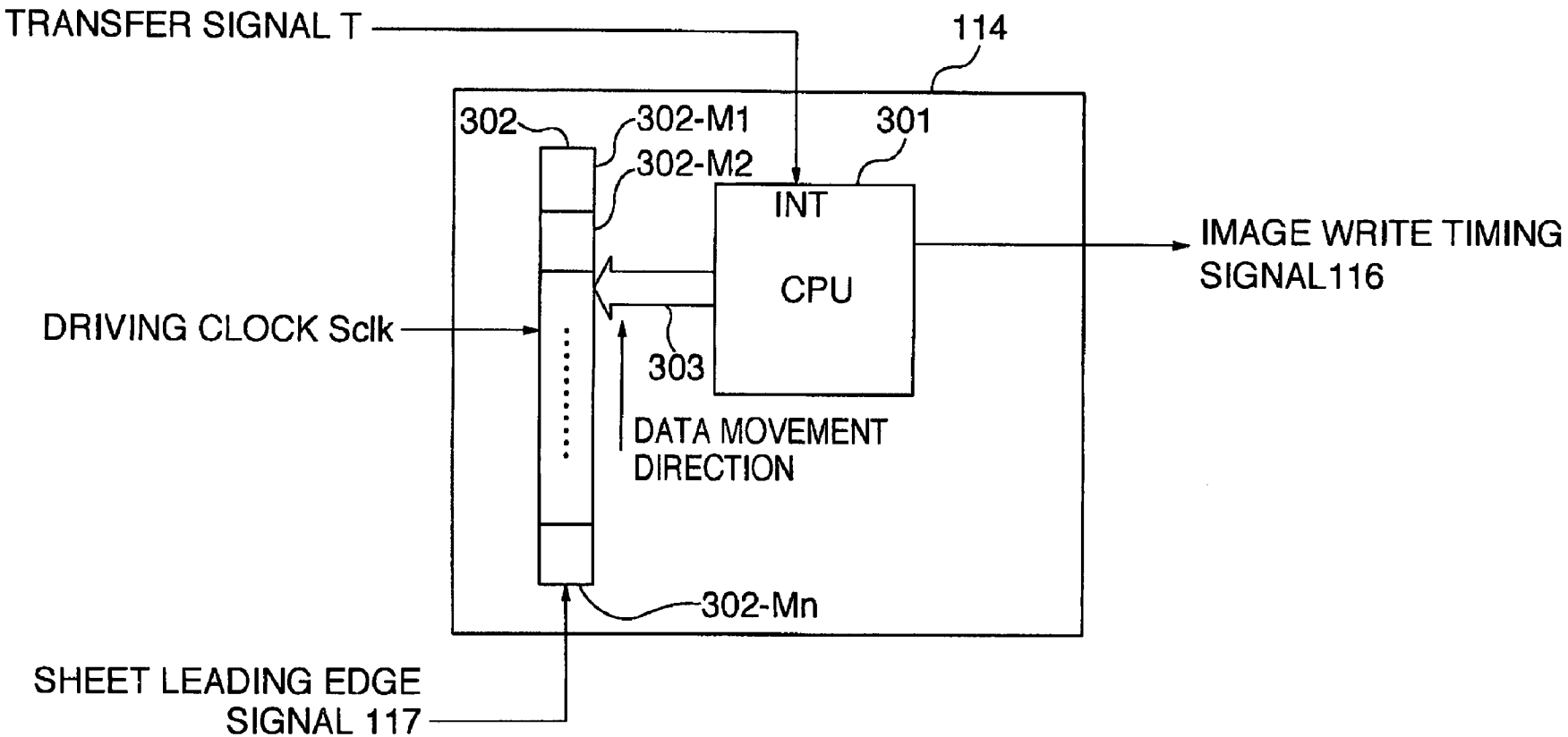
FIG. 4 is a diagram showing the detailed construction of a write timing issuing section appearing in FIG. 1.

FIG. 4 is a diagram showing the detailed construction of the write timing issuing section 114 appearing in FIG. 1.

In FIG. 4, the write timing issuing section 114 is comprised of a CPU 301, a memory array 302, and a data bus 303. The memory array 302 includes memories 302-M1 to 302-Mn.

The CPU 301 is a central processing unit that controls to output the image write timing signal 116 to the laser control section 103, and carries out the procedure shown by a flowchart in FIG. 5, described later, based on a program. The memory array 302 successively stores a state of the sheet leading edge signal 117 in the memories 302-M1 to 302-Mn of the memory array 302 in synchronization with every period of the driving clock Sclk from the driving circuit of the processing section 110. The data bus 303 is a shared signal line used when the CPU 301 reads the data in the memory array 302. The transfer signal T from the driving circuit of the processing section 110 is connected to an interrupt terminal INT of the CPU 301 and whenever the transfer signal T is issued, the driving circuit of the processing section 110 requests the CPU 301 to carry out predetermined processing.

Figure 5:
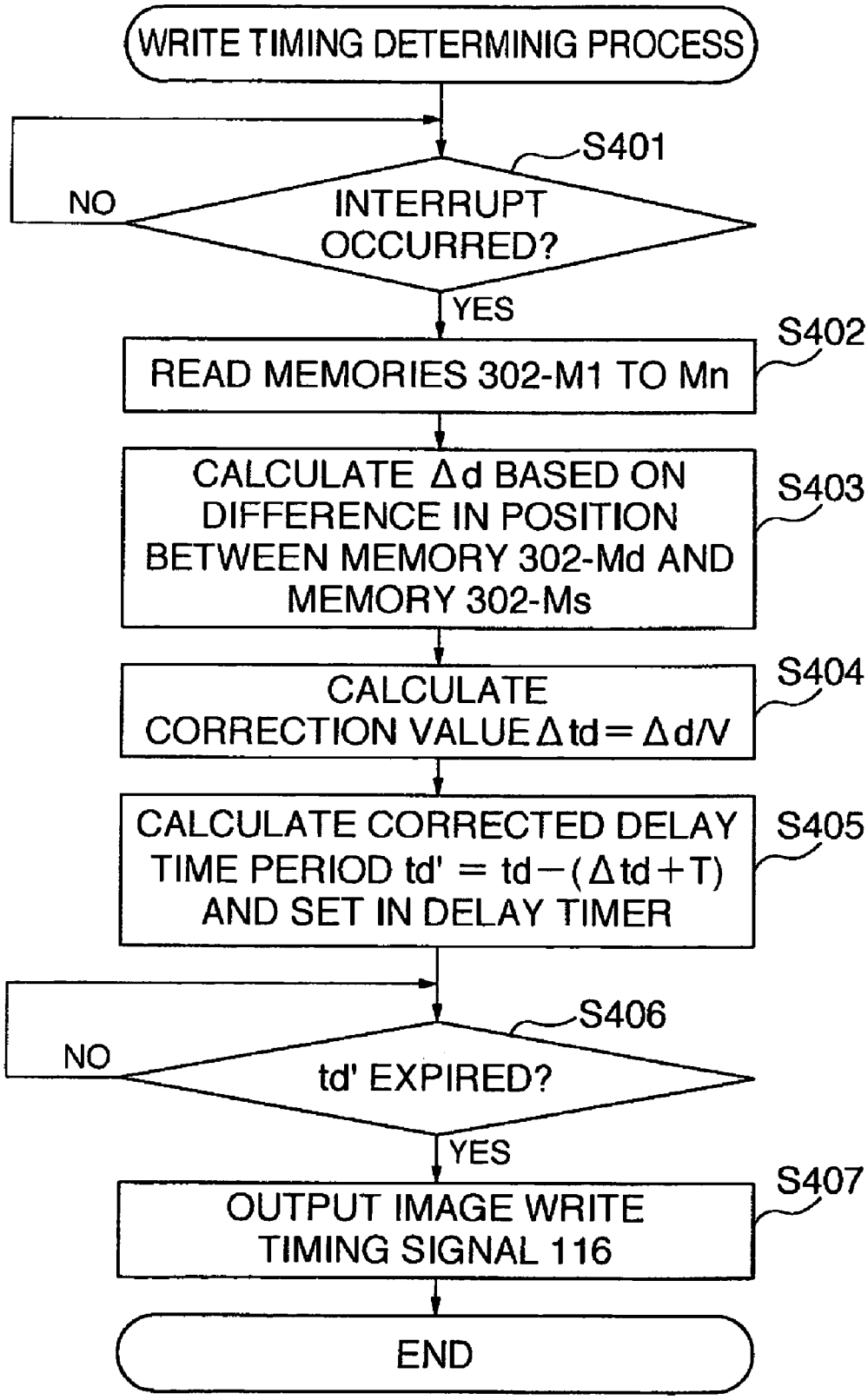
FIG. 5 is a flowchart showing the procedure of a write timing determining process carried out by a CPU of the write timing issuing section 114.

FIG. 5 is a flowchart showing the procedure of a write timing determining process carried out by the CPU 301 of the write timing issuing section 114.

In FIG. 5, after the transfer signal T(n) shown in FIG. 3 described above is issued from the driving circuit of the processing section 110, by issuing a next transfer signal T(n+1), an interrupt occurs for the CPU 301 of the write timing issuing section 114 ("YES" at step S401).

First, the CPU 301 reads the data stored in the memories 302-M1 to 302-Mn of the memory array 302 (step S402). At this time, data corresponding to the output of the light detecting pixels 109-P1 to 109-Pn of the leading edge detecting sensor 109 (i.e., the state of the sheet leading edge signal 117) is stored in the memories 302-M1 to 302-Mn. Here, data at the time when the sheet leading edge signal 117 changes from "0" to "1" (hereinafter referred to as "the image leading edge data") is stored in the memory 302-Md corresponding to the light detecting pixel 109-Pd of the leading edge detecting sensor 109.

Accordingly, the CPU 301 calculates a distance (error) Δd on the conveying path based on a difference in position between the memory 302-Md corresponding to the light detecting pixel 109-Pd and the memory 302-Ms corresponding to the light detecting pixel 109-Ps at the reference position S0 (step S403). In the example shown in FIG. 2 described above, since it is possible to recognize that the sheet has advanced by the distance Δd from the reference position S0, the CPU 301 calculates a correction value Δtd for the delay time td from the output of the sheet leading edge signal 117 to the issuing of the image write timing signal 116 according to the following expression (step S404).

$$\Delta td = \Delta d / V \quad \text{(Expression 1-4)}$$

Here, "V" represents the conveying speed of the sheet P on the conveying path (hereinafter referred to as "the sheet conveying speed").

In addition, as is clear from FIG. 3 described above, a delay equal to the transfer period T0 is produced from the issuing of the transfer signal T(n) when the leading edge detecting sensor 109 has outputted the analog signal S1 to the issuing of the transfer signal T(n+1) when the CPU 301 detects the leading edge of the sheet. The CPU 301 calculates the final delay time period td' based on $$td' = td - (\Delta td + T0) \quad \text{(Expression 1-5)}$$

and sets the delay time period td' in a delay timer (step S405).

After this, when the delay time period td' has expired, i.e., when the delay time period td' has been counted by the delay timer ("YES" at step S406), the CPU 301 outputs the image write timing signal 116 to the laser control section 103 (step S407) and the present process is terminated.

As described above, according to the present embodiment, the write timing issuing section 114 of the image forming apparatus 100 sets the standard image write timing based on the sheet conveying speed V, the sheet conveying distance Δd from the reference position S0 to the transfer position Pt, and the angle θ from the formation position of the electrostatic latent image on the photosensitive drum 107 to the transfer position Pt, and determines the image write timing by correcting the standard image write timing based on the difference in position between the sheet leading edge position Sd detected by the leading edge detecting sensor 109 and the reference position S0. By doing so, it is possible to detect the sheet leading edge position both correctly and highly accurately without the image forming control system having to operate at high speed to detect the sheet leading edge, and as a result, it is possible to carry out image formation in appropriate image write timing.

Figure 6:
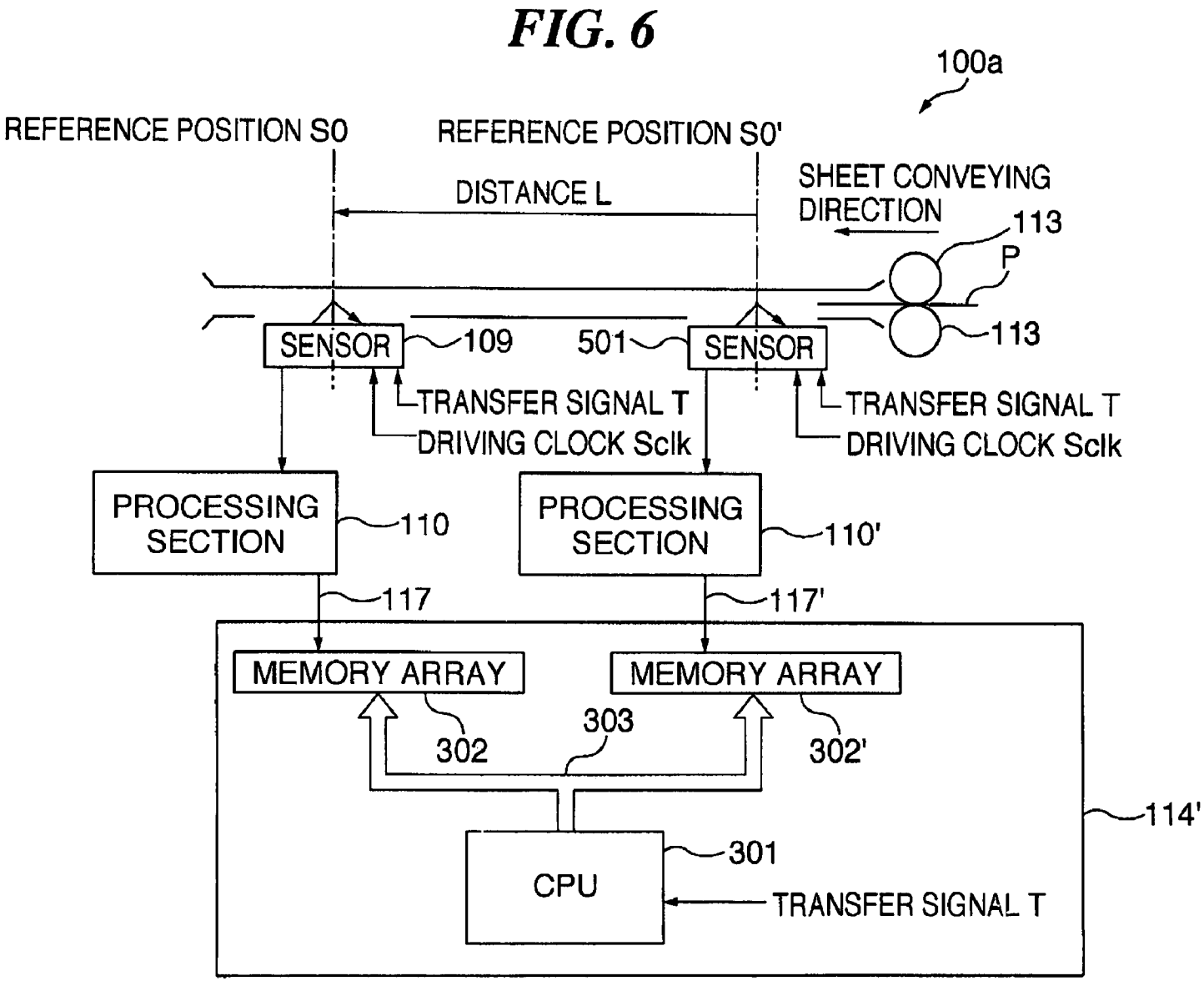
FIG. 6 is a block diagram showing the construction of principal parts of an image forming apparatus according to a second embodiment of the present invention.

FIG. 6 is a block diagram showing the construction of principal parts of an image forming apparatus according to a second embodiment of the present invention.

In FIG. 6, an image forming apparatus 100*a* is comprised of the leading edge detecting sensor 109, the processing section 110, a leading edge detecting sensor 501, a processing section 110', the CPU 301, the memory array 302, a memory array 302', the data bus 303, and the conveying rollers 113. The CPU 301, the memory array 302, the memory array 302', and the data bus 303 construct a write timing issuing section 114'. Note that component elements that are the same as those in the first embodiment (see FIGS. 1 and 4) described above are designated by the same reference numerals and description thereof is omitted or simplified.

The leading edge detecting sensor 109 is connected to the processing section 110 that outputs the sheet leading edge signal 117 and the processing section 110 is connected to the memory array 302 to which the sheet leading edge signal 117 is inputted. The transfer signal T and the driving clock Sclk are inputted to the leading edge detecting sensor 109 from a driving circuit (not shown) of the processing section 110.

The leading edge detecting sensor 501 is mounted upstream of the leading edge detecting sensor 109 on the conveying path and is constructed as an identical sensor array to the leading edge detecting sensor 109. The leading edge detecting sensor 501 is connected to the processing section 110' that outputs the sheet leading edge signal 117' and the processing section 110' is connected to the memory array 302' to which the sheet leading edge signal 117' is inputted. The transfer signal T and the driving clock Sclk are inputted to the leading edge detecting sensor 501 from a driving circuit (not shown) of a processing section 110'.

Next, the operation of the image forming apparatus according to the present embodiment will be described.

Figure 7:
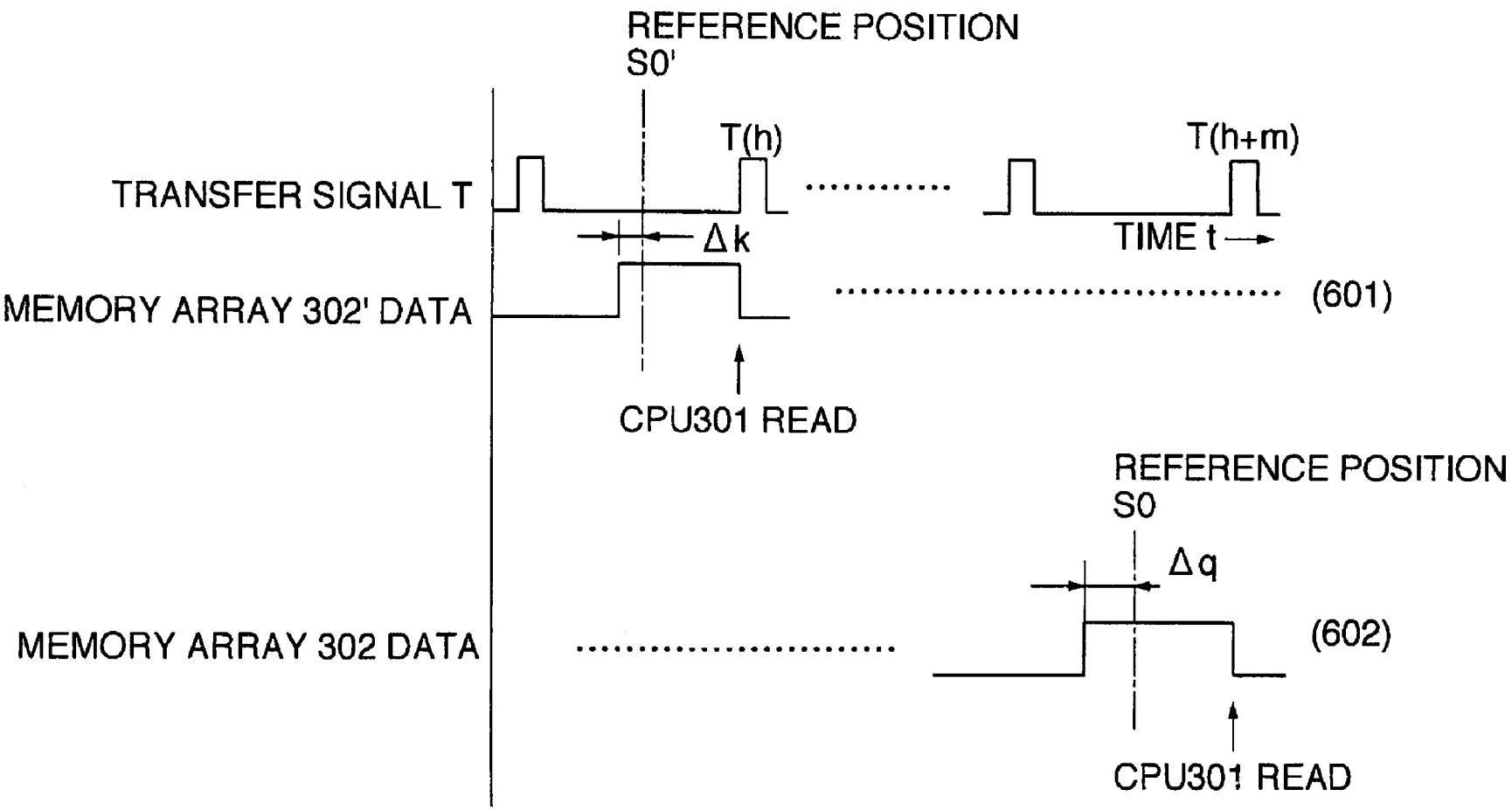
FIG. 7 is a timing chart showing a transfer signal and data of the memory arrays of the image forming apparatus shown in FIG. 6.

FIG. 7 is a timing chart showing the transfer signal T and data of the memory array 302 and the memory array 302' of the image forming apparatus appearing in FIG. 6.

In FIG. 7, a distance L between the reference position S0 at which the leading edge detecting sensor 109 is disposed and the reference position S0' at which the leading edge detecting sensor 501 is disposed can be expressed as $$L=m\cdot T0\cdot V+\Delta\beta \quad \text{(Expression 2-1)}$$

where "m" represents an integer of one or higher, "T0" the period of the transfer signal, "V" the sheet conveying speed, and "Δβ" a value determined so that $0 \leqq \Delta\beta \leqq T0\cdot V$.

In addition, when the sheet P is being conveyed, the CPU 301 reads the stored contents of both the memory array 302 and the memory array 302' in every period of the transfer signal T. At this time, the CPU 301 reads the stored content of the memory array 302' shown by chart 601 in an arbitrary period of the transfer signal T(h) to obtain a sheet leading edge position detected by the leading edge detecting sensor-501. Here, a symbol Δk in FIG. 7 is a difference in position between the reference position S0' of the leading edge detecting sensor 501 and the sheet leading edge position when the sheet leading edge is detected.

When the sheet P has been conveyed further, in the period of the transfer signal T(h+m) by reading the stored content of the memory array 302 shown in a chart 601, the detected sheet leading edge position is obtained by the leading edge detecting sensor 109. Here, a symbol Aq in FIG. 7 is a difference in position between the reference position S0 of the leading edge detecting sensor 109 and the sheet leading edge position when the sheet leading edge is detected.

Here, if there are no fluctuations in the conveying speed V of the sheet P, the relationship between Δk and Δq and Δβ described above is $$\Delta q=\Delta k-\Delta\beta \quad \text{(Expression 2-2).}$$

However, since the conveying speed V of the sheet P normally fluctuates due to slippage of the sheet P on the conveying path, errors in the diameter of the conveying rollers 113, and the like, the error ΔV of the conveying speed V is expressed as $$\Delta V=\{\Delta q-(\Delta k-\Delta\beta)\}/(m\cdot T0) \quad \text{(Expression 2-3).}$$

Accordingly, the expression (Expression 1-4) that calculates the correction value for the delay time period td described in the first embodiment above can be corrected to $$\Delta td=\Delta d/(V+\Delta V) \quad \text{(Expression 1-4)'.}$$

By doing so, the delay time period found according to (Expression 1-5) that calculates the final delay time period td' described in the first embodiment above is further corrected.

Also, as described above, according to the present embodiment, the leading edge detecting sensor 109 and the leading edge detecting sensor 501 are respectively disposed at the reference position S0 and the reference position S0' on the conveying path of the image forming apparatus, an error in the sheet conveying speed between the reference positions is calculated based on the difference in position Δk between the sheet leading edge position detected by the leading edge detecting sensor 109 and the reference position S0 and the difference in position Δq between the sheet leading edge position detected by the leading edge detecting sensor 501 and the reference position S0', and the image write timing is corrected based on such error in sheet conveying speed. By doing so, it is possible to carry out image formation in even more appropriate image write timing.

Figure 8A:
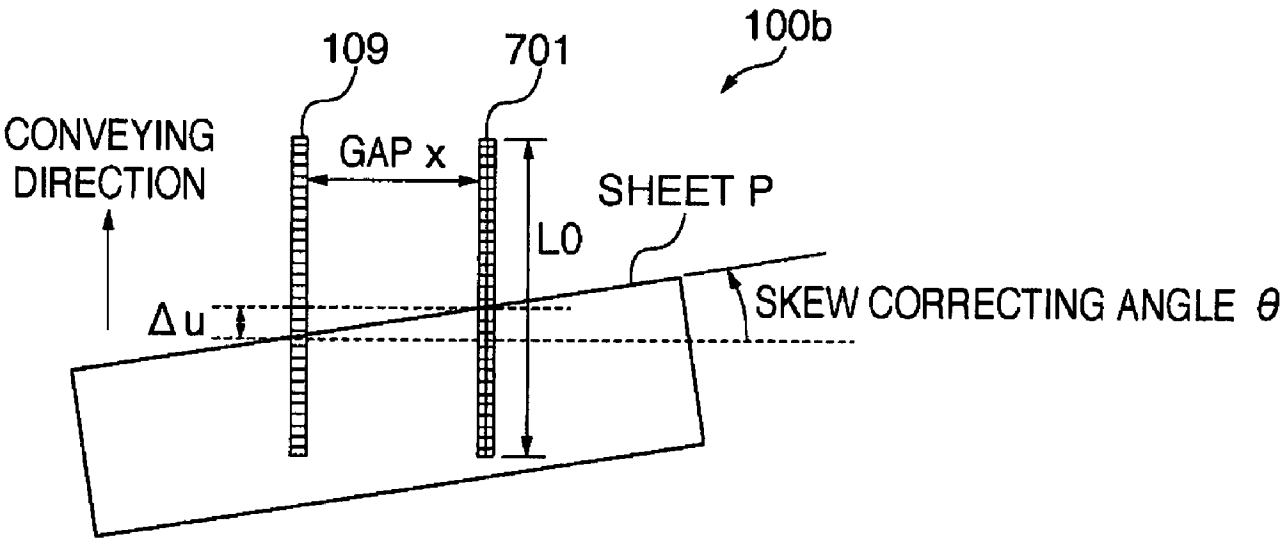
FIGS. 8A and 8B relate to an image forming apparatus according to a third embodiment of the present invention, with FIG. 8A being a diagram showing the arrangement of two leading edge detecting sensors and FIG. 8B being a timing chart showing a transfer signal and a sheet leading edge signal.
Figure 8B:
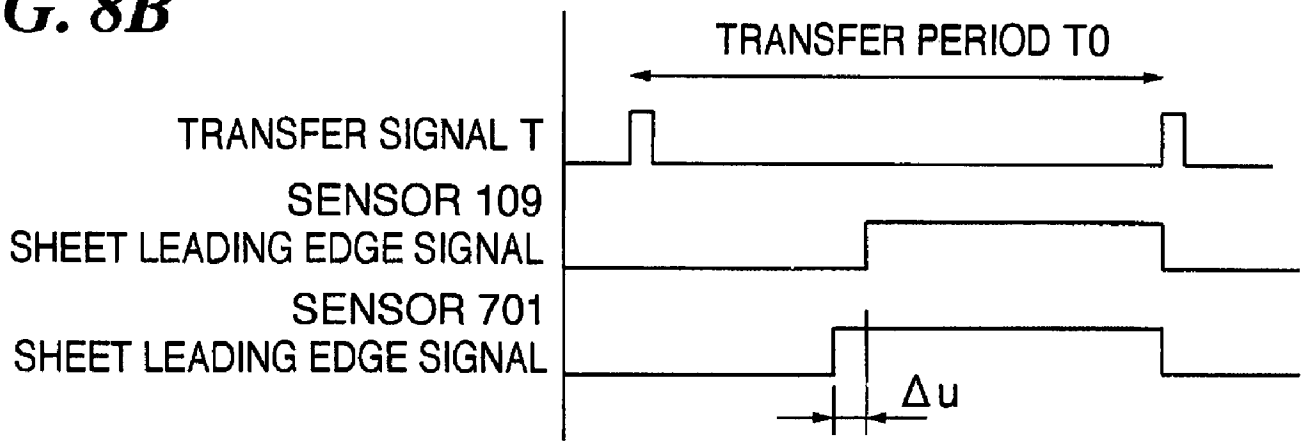
Figure 9:
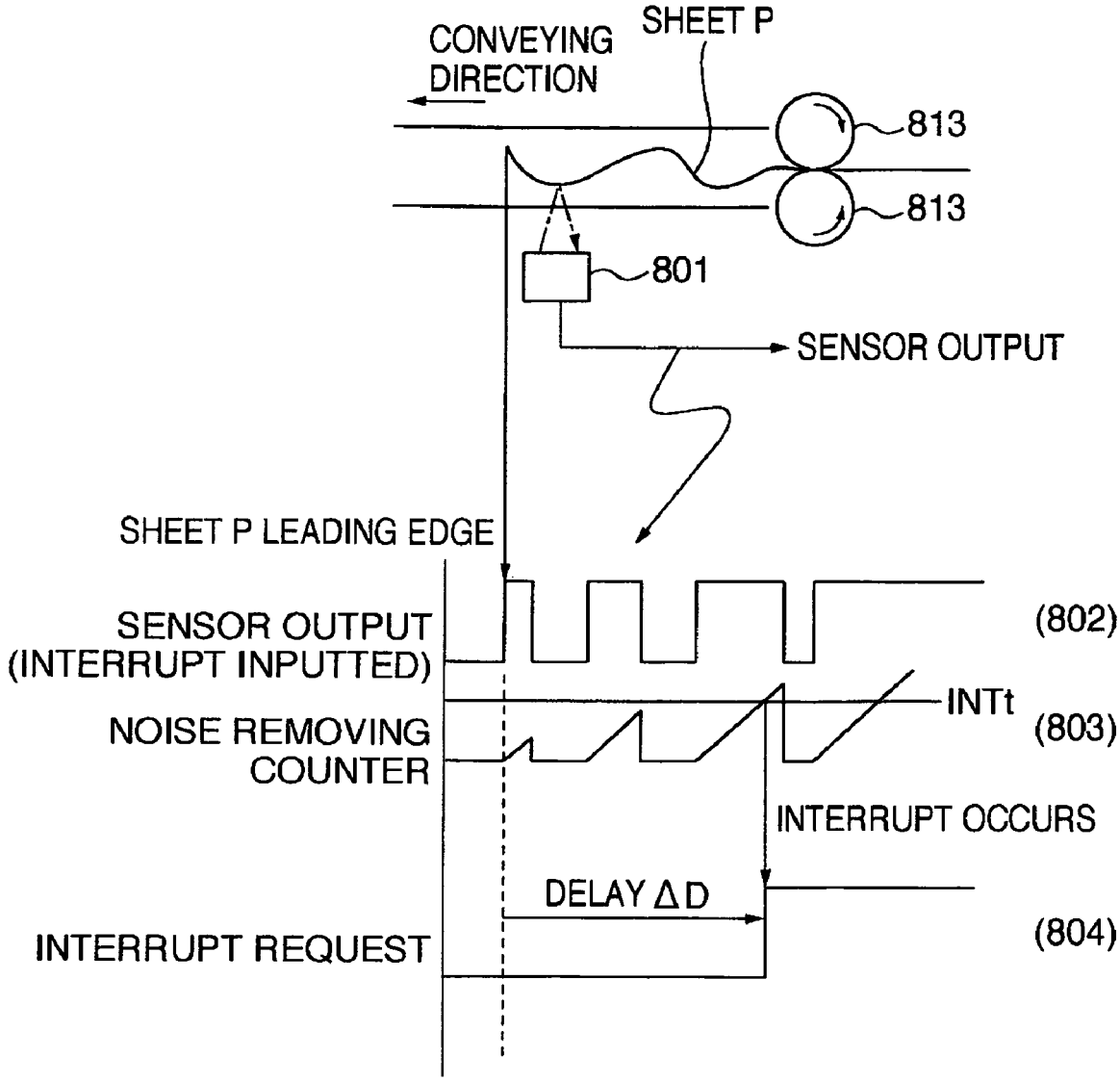
FIG. 9 is a diagram showing an output signal of a leading edge detecting sensor of a conventional image forming apparatus and issuing of an interrupt.
Figure 10B:
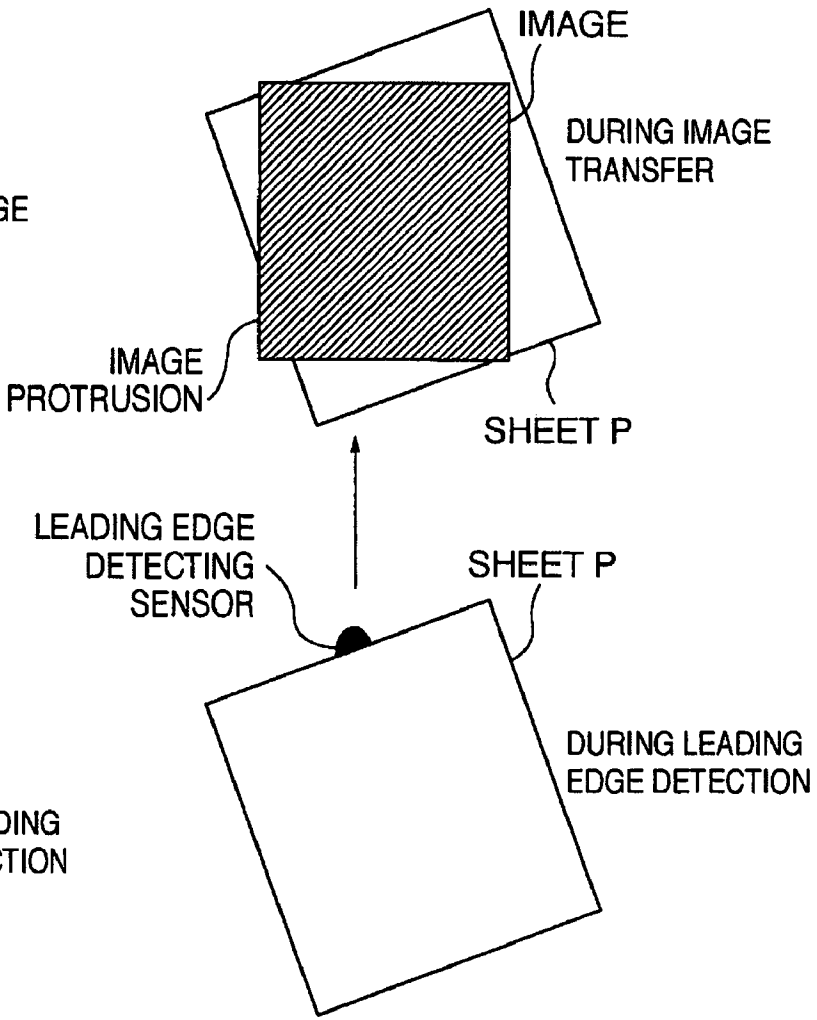
FIG. 10B (PRIOR ART)
FIGS. 10A and 10B are diagrams showing conveying states of a sheet, with FIG. 10A showing the case where the sheet is conveyed in a normal state and FIG. 10B showing the case where the sheet is conveyed in a skewed state.
Figure 10A:
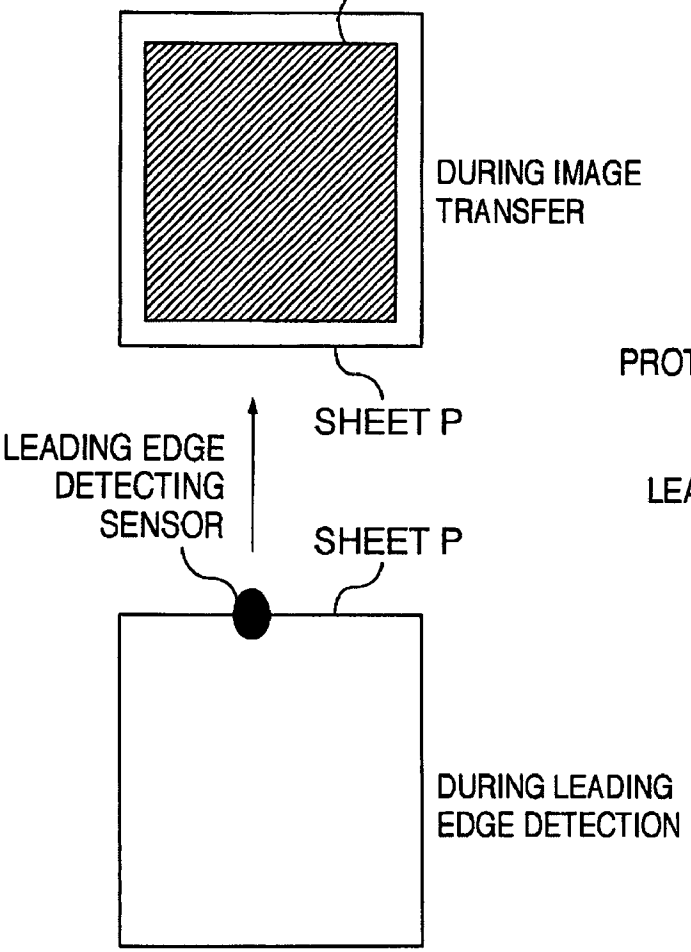
FIG. 10A (PRIOR ART)

FIGS. 8A and 8B relate to an image forming apparatus according to a third embodiment of the present invention, with FIG. 8A being a diagram showing the arrangement of two leading edge detecting sensors and FIG. 8B being a timing chart showing a transfer signal and a sheet leading edge signal.

In FIGS. 8A and 8B, the image forming apparatus 100*b* includes the leading edge detecting sensor 109 and a leading edge detecting sensor 701. Note that component elements that are the same as those in the first embodiment (see FIG. 1) described above are designated by the same reference numerals and description thereof is omitted or simplified.

The leading edge detecting sensor 701 is disposed at a fixed gap x in a sheet width direction from the leading edge detecting sensor 109 on the conveying path and with light detecting pixels thereof arranged in the sheet conveying direction. The leading edge detecting sensor 701 is constructed as a sensor array with the same construction as the leading edge detecting sensor 109.

A CPU of a write timing issuing section, not shown, compares the output of the leading edge detecting sensor 109 (left leading edge position of the sheet) and the output of the leading edge detecting sensor 701 (right leading edge position of the sheet) in a same transfer period to calculate a skew amount Δu of the sheet P.

Also, the CPU calculates the skew correcting angle θ according to $$\tan\theta=\Delta u/x \quad \text{(Expression 3-1)}$$

based on the calculated skew amount Δu of the sheet P, and the gap x between the leading edge detecting sensor 109 and the leading edge detecting sensor 701.

Based on the calculated skew correcting angle θ, it is possible to correct the image write timing, to correct the image magnification, and/or to carry out image rotation that rotates the image data by a predetermined angle.

The gap x between the leading edge detecting sensor 109 and the leading edge detecting sensor 701 is set in a range where $$w/|\tan(\theta 1)| \leqq x \leqq W(PAP) \quad \text{(Expression 3-2)}$$

where "θ1" represents a minimum detection angle, "w" a sensor pixel interval, and "W(PAP)" a minimum sheet width, and also $$x \leqq (1-\alpha)\times V/(\alpha\times T0\times|\tan\theta 2|) \quad \text{(Expression 3-3)}$$

where "θ2" represents a maximum permitted skew angle, "V" the sheet conveying speed, "T" a CCD transfer period time, and "a" a value no greater than one determined by V/Tα×L0 where "L0" represents an entire length of the leading edge detecting sensor 109.

In addition, when a $(1-\alpha)\times n^{th}$ or later light detecting pixel in one leading edge detecting sensor out of the leading edge detecting sensor 109 and the leading edge detecting sensor 701 has first detected the sheet leading edge, the sheet leading edge is regarded as having been detected. By doing so, the minimum detection angle θ1 and the maximum permitted skew angle θ2 can then be set appropriately.

As described above, according to the present embodiment, the leading edge detecting sensor 109 and the leading edge detecting sensor 701 are disposed on the conveying path of the image forming apparatus 100*b* a predetermined gap apart in the sheet width direction. Based on a difference in position between the sheet leading edge position detected by the leading edge detecting sensor 109 and the sheet leading edge position detected by the leading edge detecting sensor 701 the skew amount of the sheet is calculated and based on this skew amount, the image write timing is corrected. By doing so, even when the sheet is skewed, image formation can be carried out in appropriate image write timing without causing image formation to take longer or an increase in apparatus size.

Although no mention of the type of image forming apparatus is given in the first to third embodiments described above, the present invention can be applied to all types of image forming apparatuses (such as printers, copying machines, and multifunction devices) that carry out image formation according to the electrophotographic method.

It is to be understood that the object of the present invention may also be accomplished by supplying a system or an apparatus with a storage medium (or a recording medium) in which a program code (flowcharts in FIG. 5) of software, which realizes the functions of either of the above described embodiments is stored, and causing a computer (or CPU or MPU) of the system or apparatus to read out and execute the program code stored in the storage medium.

In this case, the program code itself read out from the storage medium realizes the functions of either of the above described embodiments, and hence the program code and the storage medium in which the program code is stored constitute the present invention.

Examples of the storage medium for supplying the program code include a floppy (registered trademark) disk, a hard disk, a magnetic-optical disk, a CD-ROM, a CD-R, a CD-RW, a DVD-ROM, a DVD-RAM, a DVD-RW, a DVD+RW, a magnetic tape, a nonvolatile memory card, and a ROM. Alternatively, the program code may be downloaded via a network from another computer, a database, or the like, not shown, connected to the Internet, a commercial network, a local area network, or the like.

Further, it is to be understood that the functions of any of the above described embodiments may be accomplished not only by executing a program code read out by a computer, but also by causing an OS (operating system) or the like which operates on the computer to perform a part or all of the actual operations based on instructions of the program code.

Further, it is to be understood that the functions of any of the above described embodiments may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

Further, the above program has only to realize the functions of either of the above described embodiments on a computer, and the form of the program may be an object code, a program code executed by an interpreter, or script data supplied to an OS.

This application claims the benefit of Japanese Application No. 2005-016136, filed Jan. 24, 2005, which is hereby incorporated by reference herein in its entirety.

What is claimed is:

1. An image forming apparatus that carries out image formation by forming an electrostatic latent image on a photosensitive drum and transferring an image produced by developing the electrostatic latent image onto a recording medium conveyed to a transfer position of the photosensitive drum, the image forming apparatus comprising:

a detection device for detecting a leading edge position of the recording medium being conveyed, the detection device including a plurality of light detecting pixels disposed upstream side of the transfer position and aligned along a recording medium conveying direction;

a determining device that determines image write timing for forming the electrostatic latent image on the photosensitive drum based on a difference in position between the leading edge position of the recording medium detected by said detection device and a predetermined reference position; and a second detection device for detecting the recording medium being conveyed, said second detection device including a plurality of second light detecting pixels disposed further upstream side of the transfer position than said light detecting pixels, and aligned along the recording medium conveying direction, wherein said determining device determines the image write timing for forming the electrostatic latent image on the photosensitive drum based on the difference in position between the leading edge position of the recording medium detected by said detection device and the predetermined reference position and a difference in position between the leading edge position of the recording medium detected by said second detection device and a predetermined second reference position.

2. An image forming apparatus as claimed in claim 1, wherein said determining device preliminarily sets standard image write timing for the predetermined reference position and determines the image write timing by correcting the standard image write timing based on the difference in position between the leading edge position of the recording medium detected by said detection device and the predetermined reference position.

3. An image forming apparatus as claimed in claim 1, wherein said determining device preliminarily sets the standard image write timing for the predetermined reference position, and determines the image write timing by correcting the standard image write timing based on the difference in position between the leading edge position of the recording medium detected by said detection device and the predetermined reference position and the difference in position between the leading edge position of the recording medium detected by said second detection device and the predetermined second reference position.

4. An image forming apparatus as claimed in claim 1, wherein said detection device detects the leading edge of the recording medium being conveyed by repeatedly reading signals output from the plurality of light detecting pixels.

5. A method of forming an image onto a recording medium in an image forming apparatus by forming an electrostatic latent image on a photosensitive drum and transferring an image produced by developing the electrostatic latent image onto the recording medium conveyed to a transfer position of the photosensitive drum, the method comprising:

a detection step of detecting a leading edge position of the recording medium being conveyed with a plurality of light detecting pixels disposed upstream side of the transfer position and aligned along a recording medium conveying direction;

a determining step of determining image write timing for forming the electrostatic latent image on the photosensitive drum based on a difference in position between the leading edge position of the recording medium detected in the detection step and a predetermined reference position; and a second detection step of detecting the recording medium being conveyed with a plurality of second light detecting pixels disposed further upstream side of the transfer position than the plurality of light detecting pixels, and aligned along the recording medium conveying direction, wherein the determining step determines the image write timing for forming the electrostatic latent image on the photosensitive drum based on the difference in position between the leading edge position of the recording medium detected in the detection step and the predetermined reference position and a difference in position between the leading edge position of the recording medium detected in the second detection step and a predetermined second reference position.

6. A method as claimed in claim 5, wherein the determining step preliminarily sets standard image write timing for the predetermined reference position and determines the image write timing by correcting the standard image write timing based on the difference in position between the leading edge position of the recording medium detected in the detection step and the predetermined reference position.

7. A method as claimed in claim 5, wherein the determining step preliminarily sets the standard image write timing for the predetermined reference position, and determines the image write timing by correcting the standard image write timing based on the difference in position between the leading edge position of the recording medium detected in the detection step and the predetermined reference position and the difference in position between the leading edge position of the recording medium detected in the second detection step and the predetermined second reference position.

8. A method as claimed in claim 5, wherein the detection step detects the leading edge of the recording medium being conveyed by repeatedly reading signals output from the plurality of light detecting pixels.

* * * * *